United States Patent [19]

Killian

[11] Patent Number: 4,970,944

[45] Date of Patent: Nov. 20, 1990

[54] ROTARY ACTUATOR

[75] Inventor: Henry R. Killian, Monroe, N.C.

[73] Assignee: Conbraco Industries, Inc., Matthews, N.C.

[21] Appl. No.: 699,331

[22] Filed: Feb. 7, 1985

[51] Int. Cl.[5] ..... F15B 15/06

[52] U.S. Cl. ..... 92/013.6; 92/69 R; 92/110; 92/136; 92/169.2

[58] Field of Search ..... 92/13.6, 68, 69 R, 50, 92/75, 110, 128, 169.2, 136, 138, 65

[56] References Cited

U.S. PATENT DOCUMENTS

| | | | |
|---|---|---|---|
| RE. 27,183 | 10/1971 | Rosaen | 92/110 |
| 1,687,366 | 10/1928 | Doolittle et al. | 92/136 X |
| 2,828,722 | 4/1958 | Bohnhoff et al. | 92/110 X |
| 3,101,639 | 8/1963 | Cederleaf | 92/110 X |
| 3,168,853 | 2/1965 | Prince | 92/110 X |
| 3,411,409 | 11/1968 | Bunyard | 92/136 X |
| 3,537,358 | 11/1970 | Bunyard | 92/136 |
| 3,738,232 | 6/1973 | Kado | 92/169.2 X |
| 4,094,231 | 6/1978 | Carr | 92/128 |
| 4,354,424 | 10/1982 | Nordlund | 92/13.6 X |
| 4,487,111 | 12/1984 | Prince | 92/136 X |

FOREIGN PATENT DOCUMENTS

| | | | |
|---|---|---|---|
| 3215507 | 8/1983 | Fed. Rep. of Germany | 92/136 |
| 3306613 | 9/1984 | Fed. Rep. of Germany | 92/136 |
| 889986 | 12/1981 | U.S.S.R. | 92/110 |

OTHER PUBLICATIONS

"Dynamate F-790", Product Brochure by Keystone Valve U.S.A., Div. of Keystone Intn'l., Inc. of Houston Texas, 1980. pp. 1-21.

*Primary Examiner*—Edward K. Look
*Assistant Examiner*—George Kapsalas
*Attorney, Agent, or Firm*—Shefte, PInckney & Sawyer

[57] ABSTRACT

An improved fluid supplying and exhausting arrangement for fluid-powered rotary motion actuating devices of the dual piston rack-and-pinion type. A first conduit arrangement includes a central opening through an axial end wall of the actuator housing and a fluid transfer tube fitted in such opening and extending axially through the adjacent piston into the intermediate fluid chamber between the two pistons for delivering fluid and exhausting fluid from the intermediate chamber, with the adjacent piston being slidable on the transfer tube in sealing contact therewith. A second conduit arrangement includes another axial opening in the end wall into the adjacent outward chamber of the housing and another transfer tube fixed to and extending axially through one piston and extending axially through the other piston to open at the opposite ends of the tube into the two outward fluid chambers of the device, with the other piston being in axially slidably sealing contact with the second tube. The fluid supply and exhausting system requires no internal porting and passageways in the annular walls of the housing so that the housing need not be entirely metal cast and may be inexpensively and simply fabricated and assembled substantially from commercially available standard materials.

6 Claims, 4 Drawing Sheets

ROTARY ACTUATOR

BACKGROUND OF THE INVENTION

The present invention relates to fluid-powered rotary motion actuating devices and particularly to such devices of the dual-piston type.

Actuators of the relevant type above-indicated characteristically have an annular housing or body containing a pair of pistons interconnected by gearing, such as a rack-and-pinion mechanism, or a like arrangement for controlling opposed reciprocal movements of the pistons toward and away from one another under operating fluid pressure while producing rotary reciprocation of the piston interconnecting arrangement to provide a desired rotary motion output therefrom. Various types of such actuators designed for both pneumatic and hydraulic operation and utilized in diverse embodiments and for differing purposes are well known. Representative examples of such actuators are disclosed in U.S. Pat. Nos. 1,667,559; 2,811,148; 2,849,888; 3,971,296; 3,982,725; 4,167,897; 4,203,351; and 4,354,424. Other representative examples of such actuators are the "WATTS RPD" and "WATTS RPS" Series double rack-and-pinion pneumatic actuators, manufactured by Watts Regulator Company, of Lawrence, Massachusetts; the "DYNAMATE F-790" pneumatic rotary actuator, manufactured by Keystone Valve USA Division of Keystone International, Inc., of Houston, Texas; the "EL-O-MATIC" pneumatic rotary actuator, which is of the basic type of the aforementioned U.S. Pat. No. 4,203,351, and is manufactured by Humabo Machinefabriek B. V., of Hengelo, Netherlands; and the "SHAFER HYTORK" pneumatic actuator, manufactured by Shafer-Hytork, of Mansfield, Ohio.

These actuators are basically operated by directing a pressurized fluid into an intermediate chamber of the housing defined between the two pistons while exhausting pressurized fluid from the chambers within the housing axially outwardly of the pistons to force the pistons away from one another and to rotate the interconnecting arrangement in one direction, and are alternately operated by directing pressurized fluid into the axially outward chambers while exhausting pressurized fluid from the intermediate chamber to force the pistons toward one another and to rotate the interconnecting arrangement in the opposite direction.

One of the engineering problems and restrictions in designing such actuators is the need to provide appropriate fluid passageways for conveying the pressurized operating to and from the fluid chambers of the actuator. Typically, this necessity is accomplished by fabricating the housing as a relatively thick-walled unitarily-cast annular metal housing to facilitate the formation of appropriate fluid passageways through the annular housing or, alternatively, relatively complex systems of tubular conduits may be arranged exteriorly of the housing for delivering fluid to and exhausting fluid from the interior chambers. In each case, the relatively complex resultant design requires correspondingly expensive fabrication and assembly of the actuator. Furthermore, with actuators of the type utilizing a cast metal housing, the necessary casting process limits the available materials from which the actuator housing can be fabricated and results in a relatively heavier and less compact actuator. On the other hand, actuators employing an exterior conduit network are similarly less compact and additionally are highly subject to breakage and damage of the fluid tubing.

In contrast, the present invention provides an actuator of the dual piston type having an improved fluid conveying system which requires neither complex porting and passageways in the actuator housing or an exterior piping or tubing system, and furthermore advantageously facilitates a simple and easy fabrication with a radically different piece parts design and using heretofore uncoventional materials.

SUMMARY OF THE INVENTION

The actuating device of the present invention adapted to be fluid-powered and basically includes a housing or like arrangement defining a cylindrical piston passageway and having end walls for substantially enclosing the axial ends of the passageway, a pair of pistons disposed coaxially within the passageway in axially-slidable sealing contact with the housing, and a piston synchronizing arrangement in operative engagement with each of the pistons for constraining them to move synchronously toward and away from one another within the passageway. The pistons and the housing cooperatively define an axially intermediate fluid chamber between the pistons in which the piston synchronizing arrangement is disposed and also define a pair of axially outward fluid chambers respectively between the pistons and the end walls. According to the present invention, the actuating device has an arrangement for delivering operating fluid under pressure to, and exhausting the fluid from, the intermediate chamber through the end wall arrangement and through the axially adjacent one of the pistons, and similarly includes an arrangement for delivering operating fluid under pressure to, and exhausting the fluid from, the outward chambers through the end wall arrangement and through the pistons.

In the preferred embodiment, a first conduit arrangement extends axially through one end wall and through the adjacent one of the pistons and opens to the intermediate chamber for delivering and exhausting operating fluid to and from the intermediate chamber, with the adjacent piston being in axially-slidable sealing contact with the first conduit arrangement. A second conduit arrangement extends axially through one end wall and through the pistons and opens to each outward chamber for delivering and exhausting operating fluid to and from the outward chambers, at least one of the pistons being in axially slidable sealing contact with the second conduit arrangement.

The actuator housing is preferably constructed of a relatively thick-walled central body having a cylindrical opening therethrough and a pair of relatively thin-walled cylinders respectively arranged in coaxial end abutment with the opposite axial ends of the body, the body and the cylinders cooperatively defining the passageway axially interiorly thereof. The housing further includes a pair of end plates respectively arranged in abutment with the axially outward ends of the cylinders radially thereacross to enclose the axial ends of the passageway. Appropriate bolts are provided joining the end plates outwardly of the body and the cylinders to maintain the body, the cylinders and the end plates in sealing relationship. An arrangement is also provided for selectively limiting the distance of axially outward movement of the pistons away from one another.

The first conduit arrangement preferably includes an opening formed axially centrally in one of the end plates and a first fluid conveying tube fitted in the axially central opening and extending axially centrally through the axially adjacent outward chamber and through the axially adjacent piston and opening into the intermediate chamber. The adjacent piston has an axially central bore therethrough which receives the first fluid conveying tube and a suitable engaging member is fitted in the bore sealably engaging the first conveying tube for axial sliding movement of the one adjacent piston therealong. The second conduit arrangement preferably includes another opening formed through the one end plate into the axially adjacent outward chamber and a second fluid conveying tube fixed to and extending axially through one of the pistons and extending axially through the other piston, with the second fluid conveying tube opening at its opposite ends respectively into the outward chambers. The two pistons have aligned axial bores therethrough, the second fluid conveying tube being fitted fixedly and sealably in the bore of one piston and extending through the aligned bore of the other piston, the other piston having a suitable engaging member fitted in its aligned bore sealably engaging the second fluid conveying tube for axial sliding movement of the other piston therealong.

In the preferred embodiment, the pistons respectively have toothed gear racks axially extending oppositely in the intermediate chamber and radially facing one another. The piston synchronizing arrangement includes a pinion gear assembly disposed in the intermediate chamber in meshing engagement with each gear rack for constraining the pistons to move synchronously toward and away from one another within the passageway. The pinion gear assembly includes a drive shaft extending radially outwardly through the central body of the housing in sealed relation therewith for rotary reciprocal movement upon movement of the pistons toward and away from one another.

It is also preferred that the one end plate in which the conduit openings are formed have affixed thereto an arrangement for connection directly with a commercially standard fluid directional control valve for fluid communication therewith of the conduit openings without utilizing intermediate piping.

DESCRIPTION OF THE PREFERRED EMBODIMENT

Figure 1:
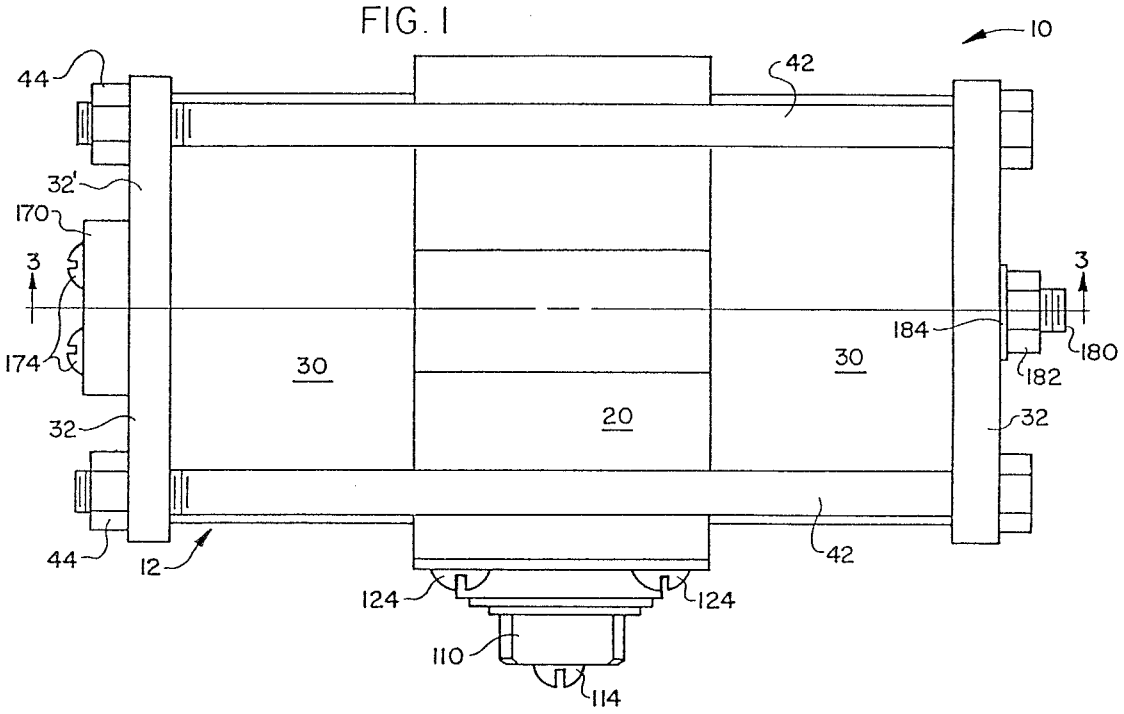
FIG. 1 is a side elevation of a fluid-powered rotary motion actuating device according to the present invention.
Figure 2:
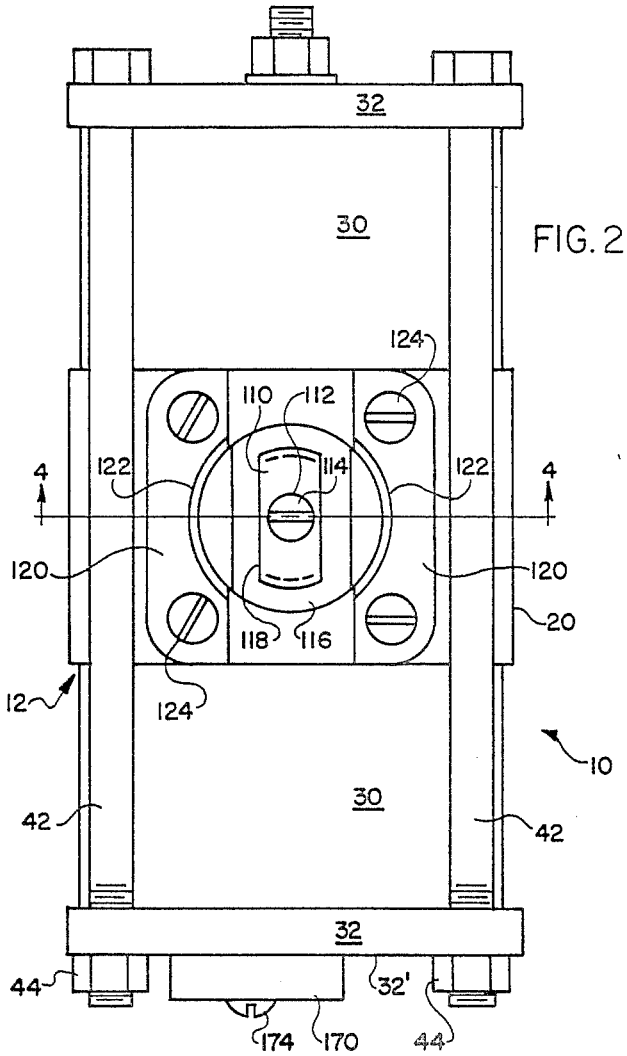
FIG. 2 is a bottom plan thereof.
Figure 3:
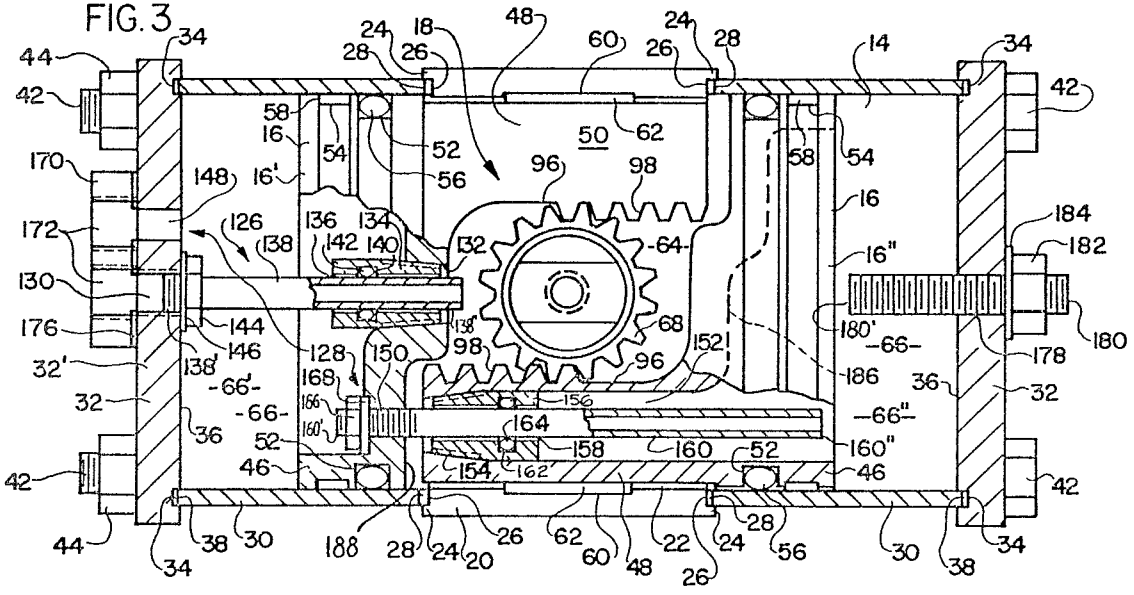
FIG. 3 is a horizontal section thereof taken along line 3—3 of FIG. 1.
Figure 4:
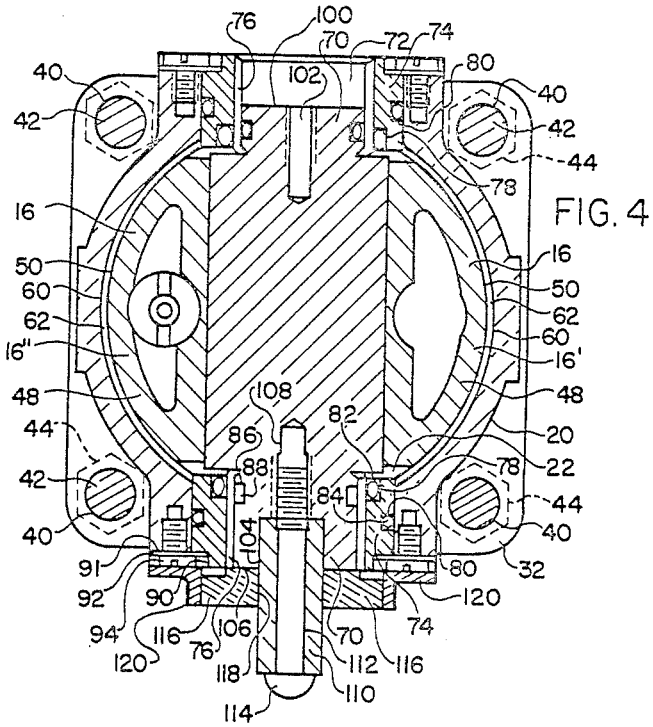
FIG. 4 is a vertical section thereof taken along line 4—4 of FIG. 2.

Referring now to the accompanying drawings, a fluid-powered rotary motion actuating device according to the preferred embodiment of the present invention is generally indicated at 10 in FIGS. 1 and 2. Basically, the device 10 includes a housing assembly 12 defining therewithin an enclosed piston passageway 14 (FIG. 3) in which a pair of piston members 16 are disposed and interconnected by an intermediate synchronizing arrangement 18 for opposed synchronous reciprocal axial sliding movement of the piston members 16 toward and away from one another and simultaneous reciprocal rotary movement of the synchronizing arrangement 18.

The housing assembly 12 includes a central body member 20 cast of an appropriate metal in a relatively thick-walled annular shape defining a cylindrical interior opening 22 therethrough. The axial ends of the central body 20 have respective axially-extending lips 24 annularly about the radially-outward edge of the body 20 forming respective circular recesses 26 in the axial ends of the body 20 radially-inwardly of the lips 24 and annularly about the axial ends of the cylindrical opening 22. A suitable washer or sealing ring 28 is fitted in each recess 26. A pair of relatively thin-walled cylinders 30 having an outer diameter indentical to the diameter of the recesses 26 are assembled coaxially with the central body 20 at the opposite axial ends thereof in end-to-end abutment therewith, the abutting axial end of each cylinder 30 being snugly fitted in the respective recess 26 against the washer or sealing ring 28 therein. A pair of end plates 32 of generally square configuration are each provided with a circular recess 34 of inner and outer diameters corresponding to the cylinders 30 formed in one face 36 of the plate 32 and fitted with a suitable washer or sealing ring 38, and the plates 32 are respectively mounted in abutment with the axially outward ends of the cylinders 30 with the faces 36 of the plates 32 extending radially thereacross and snugly receiving the axially outward ends of the cylinders 30 in the recesses 34 against the washers or sealing rings 38. The four respective corners of the end plates 32 have aligned openings 40 formed in each thereof which receive four elongated bolts 42 secured by nuts 44 to draw the central body 20, the cylinders 30 and the plates 32 into, and to retain them in, fluid-tight sealed abutment with one another.

The piston members 16 are of substantially identical construction, each having a substantially cylindrical body portion 46 and a skirt portion 48 extending axially from the radially-outward edge of the cylindrical portion 46 at one circumferential side thereof. The cylindrical portion 46 of each piston member 16 is of an outer diameter substantially identical to the inner diameter of the cylinders 30 and the skirt portion 48 is formed as a cylindrical segment substantially coaxial with the cylindrical portion 46 and having an arcuate periphery 50 closely conforming to the cylindrical interior surface of the central body 20. The piston members 16 are coaxially disposed in facing relation within the cylindrical passageway 14 of the housing assembly 12 with the cylindrical portions 46 of the piston members 16 respectively disposed within the cylinders 30 and with the skirt portions 48 respectively extending therefrom into the cylindrical opening 22 of the central body 20 toward, and in radially-opposed facing relation with, one another therein. The cylindrical portion 46 of each piston member 16 is formed with a pair of axially-spaced annular recesses 52, 54, the recess 52 being deeper than the recess 54 and being fitted with a circular "O" cross-sectionally shaped sealing ring 56 and the recess 54 being fitted with a circular flat cross-sectionally shaped bearing 58, which ring 56 and bearing 58 maintain sliding contact with the inner periphery of the respective cylinder 30 during axial sliding movement of the piston member 16 therein. Similarly, the cylindrical interior periphery of the central body 20 at the opposed locations adjacent the skirt portions 48 is provided with opposed arcuate recesses 60 fitted with correspondingly arcuate cross-sectionally flat bearing members 62 for sliding contact with the arcuate peripheries 50 of the skirt portions 48 during axial sliding movement of the piston members 16. Thus, the housing assembly 12 and the piston members 16 cooperatively define three fluid chambers within the housing assembly 12: an axially intermediate fluid chamber 64 between the piston members 16 substantially within the central body 20 and a pair of axially outward fluid chambers 66 respectively between the members 16 and the end plates 32 within the cylinders 30. The central body 20 is of a slightly smaller inner diameter than the cylinders 30 so that the axially-outwardly facing surfaces of the recess 26 protrude slightly into the piston passageway 14 to abut the facing radial surfaces of the cylindrical portions 46 of the piston members 16 upon their axial movement together to thereby act as stops to the movement of the piston members toward one another. The facing radial surfaces of the cylindrical portions 46 of the piston members 16 are compatibly profiled at 188 to receive the skirt portions 48 of each other upon axial movement of the piston members 16 together. The other outward radial surfaces of the cylindrical portions 46 of the piston members 16 are recessed at 186 to reduce their bulk and volumetric displacement.

The piston synchronizing arrangement 18 includes a toothed pinion gear 68 disposed centrally within the intermediate chamber 64 between the opposed facing skirt portions 48 of the piston members 16. The pinion gear 68 includes supporting coaxial shaft portions 70 at each axial end of the pinion gear 68, which shaft portions 70 extend outwardly from the intermediate chamber 64 through respective aligned bores 72 formed through the central body 20 at radially opposed locations thereon for rotational movement of the pinion gear 68 about an axis parallel to and intermediate of the skirt portions 48. An annular sealing bushing 74 is fitted snugly in each bore 72 and a similar sealing bushing 76 is fitted snugly about each shaft portion 70, the bushings 74, 76 being sized to sealably contact one another while permitting rotational movement of the bushings 76 with the pinion gear 68 relative to the bushings 74. Each of the bushings 74 are provided with annular interior and exterior grooves 78, 80 which receive sealing "O"-rings 82, 84 for supplementary sealing contact respectively with the bushings 76 and the bores 72. Similarly, each shaft portion 70 of the pinion gear 68 is provided with an annular groove 86 in which another sealing "O"-ring 88 is fitted for supplementary sealing contact with the bushing 76. Each bushing 74 is provided with a radially outward annular recess 90 in the axially outward end of the bushings 74, which recess 90 is disposed flush with the annular surface 91 of the central body 20 annularly about the respective bores 72. A circular washer 92 is affixed by screws 94 to each annular surface 91, with the washers 92 extending radially inwardly also across the flush surfaces of the recesses 90 in the respective bushings 74 to retain them in properly seated sealing position within the bores 72. The facing surfaces 96 of the skirt portions 48 of the piston members 16 are substantially parallel to one another and to the rotational axis of the pinion gear 68, and the facing skirt portion surfaces 96 are formed as toothed rack gears 98 which intermesh respectively with the pinion gear 68 at radially opposite sides thereof. In this manner, the toothed intermeshing engagement between the rack gears 98 of the skirt portions 48 and the pinion gear 68 constrain the piston members 16 to reciprocate synchronously in axially opposite directions toward and away from one another within the passageway 14 and simultaneously to produce reciprocal rotational movement of the pinion gear 68.

The radial face 100 of one shaft portion 70 is exposed outwardly through the receiving bore 72 in the central body 20, and the shaft portion 70 is provided with a threaded bore 102 formed axially centrally in the radial face 100 and through the shaft 70 to facilitate connection of another member or element (not shown) to the pinion gear 68 to be reciprocably rotatably driven thereby. The other shaft portion 70 of the pinion gear 68 has an enlarged recessed slot 104 formed axially centrally in the outward radial face 106 thereof and through the shaft portion 70, and includes a reduced threaded bore 108 formed axially centrally further through the shaft portion 70. An elongated sleeve member 110 of a cross-sectional shape corresponding to that of the enlarged recess 104 and having a cylindrical bore 112 formed longitudinally centrally through the member 110, is fitted snugly in the enlarged recess 104 and an elongated threaded screw 114 extends through the bore 112 in the member 110 and is threadedly engaged in the threaded bore 108 so that the assembly of the screw 114 and the member 110 extend axially outwardly from the respective shaft portions 70 of the pinion gear 68 to the exterior of the central body 20 to permit manual rotation of the pinion gear 68 and, in turn, manual actuation of axial sliding movement of the piston members 16. A disk 116 having a central opening 118 corresponding in shape to the member 110 is fitted snugly thereabout immediately adjacent the radial face 106 of the respective shaft portion 70 for rotation of the disk 116 with the member 110. A pair of flange members 120 having arcuate recesses 122 configured correspondingly to the outer periphery of the disk 116, are affixed by screws 124 to the annular surface 91 of the central body 20 adjacent the disk 116 with the recesses 122 of the flange members 120 positioned closely adjacent the periphery of the disk 116 to enclose it. The shape of the member 110 and the disk 116 provide a visual indication of the relative rotational disposition of the pinion gear 68, and the corresponding relative axial dispositions of the piston members 16, within the housing assembly 12.

According to the present invention, the actuating device 10 is uniquely provided with a system of fluid supply conduits for delivering pressurized operating fluid to, and exhausting the fluid from, the fluid chambers 64, 66 axially through one end plate 32 and axially through the piston members 16. More particularly, a first conduit arrangment, generally indicated at 126, extends axially centrally through the one end plate 32', through the axially adjacent outward chamber 66' and through the axially adjacent piston member 16' and opens to the intermediate chamber 64 for delivery to and exhaust from the intermediate chamber 64. A second conduit arrangement, generally indicated at 128, extends axially through the one end plate 32' and axially through each of the piston members 16 for fluid delivery to and exhaust from the two outward chambers 66.

The first conduit arrangement 126 includes a threaded bore 130 formed axially centrally through the end plate 32' and a coaxially aligned enlarged threaded bore 132 formed axially centrally through the adjacent piston member 16'. An exteriorly-threaded bushing sleeve 134 having a smooth-walled cylindrical opening axially-centrally therethrough, is threadedly engaged in the bore 132 with the threaded bore 130 in the end plate 32' and the cylindrical opening 136 in the bushing 134 coaxially aligned with one another. A cylindrical fluid transfer tube 138, one end 138' of which is exteriorly threaded, is threadedly engaged by its end 138' in the opening 130 and extends therefrom axially centrally through the adjacent outward chamber 66' and through the opening 136 in the bushing 134, the opposite terminal end 138" of the tube 138 opening into the intermediate chamber 64. The bushing 134 has an annular interior recess formed about the central opening 136 with a sealing "O"-ring 142 being fitted in the recess 140 for maintaining sealing contact with the periphery of the transfer tube 138 during axial sliding movement of the piston member 16' in the passageway 14. A jam nut 144 is threadedly mounted on the portion of the threaded end 138' of the transfer tube 138 within the outward chamber 66 and holds a sealing washer 146 in fluid-tight engagement with the interiorly-facing surface of the end plate 32' annularly about the central bore 130. In this manner, operating fluid may be delivered through the opening 130 and the transfer tube 138 to the intermediate chamber 64 during and without restriction of axial sliding movement of the piston 16'.

The second conduit arrangement 128 includes a cylindrical bore 148 formed axially through the end plate 32' at a small radial spacing from the central threaded bore 130 to open into the adjacent outward chamber 66'. The second conduit arrangement 128 further includes a threaded bore 150 formed axially through the cylindrical portion 46 of the piston member 16' at the radially opposite side thereof from its skirt portion 48 and an enlarged bore 152 formed axially through the skirt portion 48 and the cylindrical portion 46 of the other piston member 16" in coaxial alignment with the threaded bore 150 in the piston member 16'. The enlarged bore 152 in the piston member 16" has a threaded portion 154 at the end of the bore 152 most closely adjacent the piston member 16' and its bore 150. An exteriorly-threaded sealing sleeve bushing 156 having a cylindrical opening 158 formed axially centrally therethrough is threadedly engaged in the threaded portion 154 of the bore 152 with the central opening 158 in coaxial alignment with the threaded bore 150 in the piston member 16'. A second fluid transfer tube 160, one end 160' of which is exteriorly-threaded, is threadedly engaged by its end 160' in and extends entirely through the threaded bore 150 in the piston member 16' so that the tube end 160' is exposed in and opens into the outward chamber 66', with the remaining length of the transfer tube 160 extending therefrom through the central opening 158 in the bushing 156 and through the length of the bore 152 in the piston member 16" with the other end 160" of the transfer tube 160 opening into the other outward chamber 66". The bushing 156 has an annular recess 162 formed interiorly about the central opening 158 and a sealing "O"-ring 164 is fitted in the recess 162 to maintain sealing contact with the periphery of the transfer tube 160 during axial sliding movement of the piston members 16', 16". A jam nut 166 is threadedly engaged on the portion of the threaded end 160' of the transfer tube 160 projecting into the outward chamber 66', and holds a sealing washer 168 in fluid-tight contact with the adjacent surface of the cylindrical portion 46 of the piston member 16' annularly about the threaded bore 150. In this manner, the transfer tube 160 is fixed to the piston member 16' to move integrally therewith during axial sliding movement thereof and the tube 160 extends slidably through the piston member 16" in sealed relation therewith for relative sliding movement between the tube 160 and the piston member 16" during the corresponding axial sliding movement of the piston member 16". The transfer tube 160 thus provides continuous fluid communication between the outward chambers 66', 66" permitting operating fluid to be delivered to and exhausted from the outward chambers 66 through the opening 148 through the end plate 32' into and from the outward chamber 66' and through the transfer tube 160 into and from the other outward chamber 66" during and without restricting axial sliding movement of the piston members 16 within the passageway 14 of the housing assembly 12.

The openings 130, 148 in the end plate 32' are adjacent space from one another precisely the same distance as the two outlet openings of a conventional commercially-standard four-way fluid directional control valve (not shown) to permit the actuator 10 to be mounted at the end plate 32' directly to such a conventional control valve without the need for utilizing intermediate fluid-conveying piping or tubing. For this purpose, an adaptor plate 170 having a pair of threaded bores 172 formed therethrough at a spacing exactly corresponding to the spacing between the openings 130, 148, is sealably affixed to the outwardly facing surface of the end plate 32' by screws 174 and with an intermediate sealing gasket 176 sandwiched between the adaptor plate 170 and the end plate 32', with the bores 172 of the adaptor plate 170 and the openings 130, 148 in the end plate 32' respectively in exact coaxial alignment with one another. The adaptor plate 170 and a conventional fluid directional control valve may thus be directly connected to one another with the bores 172 in fluid commuicating alignment with the fluid outlet openings of the control valve by utilizing a pair of threaded connecting sleeves engaged respectively in the bores 172 and the valve openings.

The other end plate 32" has a threaded bore 178 formed axially centrally therethrough and a correspondingly threaded screw 180 engaged in the bore 178 to extend into the adjacent outward chamber 66". As will be understood, the screw 180 may be selectively rotated within the bore 178 to position the end 180' of the screw 180 at any selected spacing from the end plate 32' to act as a stop against movement of the piston member 16" toward the end plate 32" and thereby to limit the maximum travel of the piston members 16 away from one another and the maximum angular extent of rotational reciprocatory movement of the pinion gear 68. A jam nut 182 is threaded engaged on the exteriorly exposed end of the screw 180 and holds a sealing washer 186 in fluid-tight contact with the exterior face of the end plate 32" annularly about the bore 178, to retain the screw 180 against undesired movement. In this manner, the positionability of the screw 180, in permitting the selective control of the angular extend of rotational movement of the pinion gear 68, permits the actuator 10 to be selectively adapted for controlling various driven members through various angular ranges of rotary reciprocal movement. For example, the actuator 10 may be advantageously utilized for controlling the reciprocatory rotational turning of a fluid valve between on and off positions or between other operating positions thereof.

In operation, as heretofore indicated, the actuating device 10 is connected by the adaptor plate 170 to a conventional commercially-standard fluid directional control valve (not shown) or to another source of supply of pressurized fluid for the respective openings 130, 148 of the conduit arrangement 126, 128, and is further connected by the shaft portion 70′ of the pinion gear 68 to a driven member, e.g., the control member of a fluid valve to control rotary reciprocal movement thereof. Upon supply of pressurized fluid through the opening 130, the pressurized fluid flows through the transfer tube 138 into the intermediate chamber 64 wherein the pressurized fluid acts against the piston members 16 to force them to move axially within the housing assembly 12 away from one another. As a result, the rack gears 98 of the skirt portions 48 of the piston members 16 act upon the pinion gear 68 to rotate it in a counterclockwise direction, as viewed in FIG. 3. As the piston members 16 move away from one another, the volumetric capacity of the outward chambers 66 is decreased. As a result, a portion of the fluid occupying the outward chamber 66″ is exhausted through the transfer tube 160 into the outward chamber 66′ from which a quantity of the fluid occupying the outward chambers 66 equal to the quantity of fluid delivered to the intermediate chamber 64 is exhausted through the opening 148. This movement of the piston members 16 away from one another continues, so long as pressurized fluid continues to be supplied through the opening 130, until the recessed surface 186 of the piston member 16″ engages the limiting screw 180. Upon delivery of pressurized fluid through the opening 148, the pressurized fluid enters the outward chamber 66′ and therefrom flows through the transfer tube 160 into the outward chamber 66″. The pressurized fluid in the outward chambers 66 act on the piston members 16 to force them to move axially within the housing assembly 12 toward one another. In turn, the rack gears 98 of the skirt portions 48 of the piston members 16 act on the pinion gear 68 to cause it to rotate in a clockwise direction, as viewed in FIG. 3. As will be understood, the movement of the piston members 16 toward one another causes the volumetric capacity of the intermediate chamber 64 to be decreased, whereby a portion of the fluid occupying the intermediate chamber 64 is exhausted therefrom through the transfer tube 138 and through the opening 130. This movement of the piston members 16 toward one another continues, so long as pressurized fluid continues to be supplied through the opening 148, until the cylindrical portions 46 and the axially-outwardly facing surfaces of the recess 26 of the body 20 come into abutment with one another.

Advantageously, the unique design of the conduit arrangements 126, 128 for supplying pressurized fluid to the chambers 64, 66 axially through the end plate 32′ and through the piston members 16 entirely eliminates any need for providing passageways and porting through the annular walls of the central body 20 and the cylinders 30 and furthermore requires absolutely no exterior piping or tubing. As a result, the necessity existing with conventional actuators of metal casting the entire housing assembly of the actuator is totally avoided. In the present actuating device 10, only the central body 20 is metal cast in order to provide stability for the rotational support of the pinion gear 68. Otherwise, the housing assembly 12 of the actuating device 10 of the present invention is fabricated of uncomplex, inexpensive, commercially available components. Specifically, the cylinders 30 are formed of appropriate lengths of ordinary commercially available thin-walled tubing such as drawn aluminum or fiberglass-reinforced plastic tubing. The end plates 32 are formed from ordinary commercially available plate metal. As will be understood, the process of fabrication of the components for the present actuating device 10 is substantially simplified and less expensive in comparison with conventional actuating devices of the relevant type. Furthermore, the process of assembly of the actuating device 10 is equally simplified over and less expensive than conventional actuating devices. The unique conduit arrangements 126, 128 of the present actuating device 10 also facilitate the use of the adaptor plate 170 for direct mounting of the device 10 to a fluid-supplying directional control valve without the need for use of intermediate tubing or piping. As will be understood, this is not possible with conventional actuating devices having internal porting through the housing walls, and, of course, is also absent in conventional actuating devices utilizing exterior tubing. As a result, the overall assembly of the present actuating device with the fluid supplying control valve and with the driven valve or other member is substantially sturdier, more compact and less subject to damage than conventional actuating devices.

The present invention has been described in detail above for purposes of illustration only and is not intended to be limited by this description or otherwise to exclude any variation or equivalent arrangement that would be apparent from, or reasonably suggested by the foregoing disclosure to the skill of the art.

I claim:

1. A fluid-powered rotary motion actuating device comprising:

housing means defining and enclosed cylindrical piston passageway, said housing means including a relatively thick-walled central body having a cylindrical opening therethrough and a pair of relatively thin-walled cylinders respectively arranged in coaxial end abutment with the opposite axial ends of said body, said body and said cylinders cooperatively defining said passageway axially interiorly thereof, and a pair of end plates respectively arranged in abutment with the axially outward ends of said cylinders radially thereacross to enclose the axial ends of said passageway;

a pair of pistons disposed in facing relation coaxially within said passageway in axially-slidable sealing contact with said body and said cylinders, said pistons and said housing means cooperatively defining an axially intermediate fluid chamber between said pistons substantially within said body and defining a pair of axially outward fluid chambers respectively having toothed gear racks axially extending oppositely in said intermediate chamber and radially facing one another;

pinion gear means disposed in said intermediate chamber in meshing engagement with each said gear rack for constraining said pistons to move synchronously toward and away from one another within said passageway, said pinion gear means including a drive shaft extending radially outwardly through said central body in sealed relation therewith for rotary reciprocal movement upon movement of said pistons toward and away from one another;

first conduit means for delivering operating fluid under pressure to, and exhausting said fluid from, said intermediate chamber, said first conduit means including an opening formed axially centrally in one said end plate and a first fluid conveying tube fitted in said axially central opening and extending axially centrally through the axially adjacent outward chamber and through the axially adjacent one of said pistons and terminating within said intermediate chamber in fluid communication therewith, said one piston being in axially-slidable sealing contact with said first fluid conveying tube; and second conduit means for delivering operating fluid to, and exhausting said fluid from, said outward chambers, said second conduit means including another opening formed through said one end plate into the axially adjacent outward chamber and a second fluid conveying tube fixed to and extending axially through one said piston and extending axially through the other said piston, said other piston being in axially-slidable sealing contact with said second fluid conveying tube, said second fluid conveying tube having opposite ends terminating and opening respectively within said outward chambers in fluid communication therewith.

2. A fluid powered rotary motion actuating device according to claim 1 and characterized further in that said one piston has an axially central bore therethrough receiving said first fluid conveying tube and means fitted in said bore sealably engaging said first fluid conveying tube for axial sliding movement of said one piston therealong.

3. A fluid-powered rotary motion actuating device according to claim 2 and characterized further in that said pistons have aligned axial bores therethrough, said second tube being fitted fixedly and sealably in the bore of said one piston and extending through the aligned bore of said other piston, said other piston having means fitted in its said aligned bore sealably engaging said second fluid conveying tube for axial sliding movement of said other piston therealong.

4. A fluid-powered rotary motion actuating device according to claim 3 and characterized further by bolt means joining said end plates outwardly of said body and said cylinders to maintain said body, said cylinders and said end plates in assembly in sealing relationship.

5. A fluid-powered rotary motion actuating device according to claim 4 and characterized further by means for selectively limiting the distance of axially outward movement of said pistons away from one another.

6. A fluid-powered rotary motion actuating device according to claim 1 and characterized further by means affixed to said one end plate for connection directly with a commercially standard fluid directional control valve for fluid communication therewith of said axially central opening and said another opening without utilizing intermediate piping.

* * * * *

UNITED STATES PATENT AND TRADEMARK OFFICE

CERTIFICATE OF CORRECTION

PATENT NO. : 4,970,944

DATED : November 20, 1990

INVENTOR(S) : Henry R. Killian

It is certified that error appears in the above-identified patent and that said Letters Patent is hereby corrected as shown below:

Title Page:
Abstract, Line 18, reads "slidably" but should read -- slidable --.

Column 1, Line 52, after "operating" add -- fluid --.

Column 2, Line 13, after "invention" add -- is --.

Column 3, Line 8, after "first" add -- fluid --.

Column 6, Line 50, reads "arrangment" but should read -- arrangement --.

Column 8, Lines 13-14, reads "adjacent space" but should read -- adjacently spaced --.

Column 8, Line 55, reads "extend" but should read -- extent --.

Column 10, Line 31, reads "and" but should read -- an --.

Signed and Sealed this

Twenty-second Day of September, 1992

*Attest:*

DOUGLAS B. COMER

*Attesting Officer*

*Acting Commissioner of Patents and Trademarks*